United States Patent [19]

van der Heijden

[11] Patent Number: 5,001,387

[45] Date of Patent: Mar. 19, 1991

[54] ELECTRIC LAMP AND LAMP CAP

[75] Inventor: Johannes M. A. van der Heijden, Eindhoven, Netherlands

[73] Assignee: U.S. Philips Corporation, New York, N.Y.

[21] Appl. No.: 101,879

[22] Filed: Sep. 28, 1987

[30] Foreign Application Priority Data

Sep. 22, 1986 [NL] Netherlands ..... 8602379

[51] Int. Cl.[5] ..... H01J 5/58

[52] U.S. Cl. ..... 313/318; 313/25; 313/33; 313/43; 445/38

[58] Field of Search ..... 313/318, 332, 25, 33, 313/623, 624, 43; 445/26, 27, 38, 44; 439/611-619

[56] References Cited

U.S. PATENT DOCUMENTS

| | | | |
|---|---|---|---|
| 2,084,478 | 6/1937 | Clark | 313/318 |
| 2,454,270 | 11/1948 | Braunsdorff | 445/27 |
| 3,979,627 | 9/1976 | Leadvaro et al. | 313/318 |
| 4,028,577 | 6/1977 | Gates et al. | 313/318 |
| 4,126,810 | 11/1978 | Cox | 313/318 |
| 4,243,907 | 1/1981 | Kohl et al. | 313/318 |
| 4,568,854 | 2/1986 | Westlund, Jr. et al. | 313/318 |

FOREIGN PATENT DOCUMENTS

| | | | |
|---|---|---|---|
| 881106 | 11/1961 | United Kingdom | 313/318 |

*Primary Examiner*—Donald J. Yusko
*Assistant Examiner*—Michael Horabik
*Attorney, Agent, or Firm*—Brian J. Wieghaus

[57] ABSTRACT

The electric lamp has a lamp vessel (1) which is fixed by means of cement (6) in a lamp cap (3) of synthetic material. A metal ring (7) in contact with the cement (6) is present in the lamp cap (3), as a result of which the cement (6) can be secured by inductive heating of the metal ring (7). The lamp cap (3) has ribs (10,11) on the inside surface of the lamp cap (3), by which the metal ring (7) is radially and axially separated from the lamp cap (3).

5 Claims, 1 Drawing Sheet

ELECTRIC LAMP AND LAMP CAP

BACKGROUND OF THE INVENTION

The invention relates to an electric lamp comprising:

a translucent lamp vessel in which an electric light source is arranged;

a lamp cap with an axis whose wall mainly consists of synthetic material and which has electrical contacts on its outer side;

current-supply conductors extending from the light source to electrical contacts at the lamp cap, the lamp vessel being partly sunk into the lamp cap and being fixed on the inner side thereof by means of cement, and a metal ring in contact with the cement being present in the lamp cap.

Such a lamp is known from German Patent Specification No. 452 751 (Patent Treuhand Gesellschaft No. 18-111927).

With the use of a lamp cap of electrically insulating material, it may be difficult to cure the cement with which the lamp vessel has to be fixed in the lamp cap because the lamp cap poorly conducts the heat required for this curing process.

According to the aforementioned German Patent Specification, a metal ring, which is in contact with the cement, is present in the lamp cap so that the cement can be cured by inductively heating the ring. The heat then need not be transported through the wall of the lamp cap to the interior. The metal ring is sunk into the wall of the lamp cap on the inner side thereof. In another known lamp, the ring is located loosely in the lamp cap before the cement is cured.

It has been found that the use of the metal ring in a lamp cap of synthetic material, in order to heat and to cure the cement by inductively heating the ring, involves the risk that the lamp cap is heated excessively by the metal ring and is consequently deformed.

SUMMARY OF THE INVENTION

The invention has for its object to provide a construction in which the risk of deformation of the lamp cap during the process of curing the cement is avoided.

According to the invention, spacer means are present, which separate the metal ring from the wall of the lamp cap.

If a metal ring is received in the lamp cap and in contact with the wall of the lamp cap, the inductive heating of the metal ring also involves a strong local heating of the wall of the lamp cap, which may lead to deformation of the lamp cap. It has been found that, when the lamp cap is spaced from the metal ring, local excessive heating and hence deformation of the lamp cap is avoided.

It has proved to be easy to ensure that the spacer means are integral with the lamp cap in the form of circumferentially spaced first projections, preferably ribs, on the inside surface of the lamp cap. The projections separate the ring in radial directions from the wall of the lamp cap. They form a heat resistance between the metal ring and the wall of the lamp cap from which they project.

Due to the fact that the metal ring is kept separated from the wall of the lamp cap, the cement can contact the wall of the lamp cap, except at the area of projections, around the metal ring. Thus, it is possible for the cement to be uniformly applied to the lamp cap on all sides.

In a favourable embodiment, the spacer means also comprises a second projection on the inner wall of the lamp cap, which separates the ring in axial direction from the wall of the lamp cap. This embodiment provides the possibility of choosing, when the lamp cap and the lamp vessel are joined and when the cement is cured, between a position in which the lamp cap is situated above the lamp vessel and a position in which the lamp cap is situated below the lamp vessel and in which the metal ring could therefore be displaced, in the absence of the projection axially supporting it, to a base portion of the lamp cap.

In a favourable modification, mechanical fixing means are provided, which lock the metal ring against displacement in axial directions in the lamp cap. These mechanical means can be used with or without a projection axially supporting the ring. This modification affords the advantage that the lamp cap and the metal ring can be supplied as one unit in the step of manufacturing the lamp in which the lamp vessel is provided with the lamp cap. Another advantage is that the step of joining the lamp cap, the lamp vessel and the metal ring, especially in case the lamp cap is situated above the lamp vessel, is simplified. The mechanical fixing means may consist of barbed arms extending from the metal ring and projections on the inner surface of the lamp cap into which the barbed arms engage.

In the non-prepublished Netherlands Patent Application No. 8601092, to which U.S. application Ser. No. 043,902 corresponds, an electric lamp is described, in which a housing of synthetic material is connected at one end to a lamp vessel and at the second end to a lamp cap. Therein, a metal ring is adhered to the lamp vessel by means of glue and the unit of the lamp vessel and the ring is then secured in the housing of synthetic material. In an entirely finished lamp, the unit is secured entirely mechanically by means of barbed arms provided on the ring and engaging into projections on the wall of the housing of synthetic material.

It is not essential to the invention whether the lamp is an incandescent lamp, in which the light source is a filament that may be present in an inner envelope, or a discharge lamp, such as a discharge lamp in which the light source is a pair of electrodes in an ionizable gas that may be present in an inner envelope.

DETAILED DESCRIPTION OF THE PREFERRED EMBODIMENT

Figure 1:
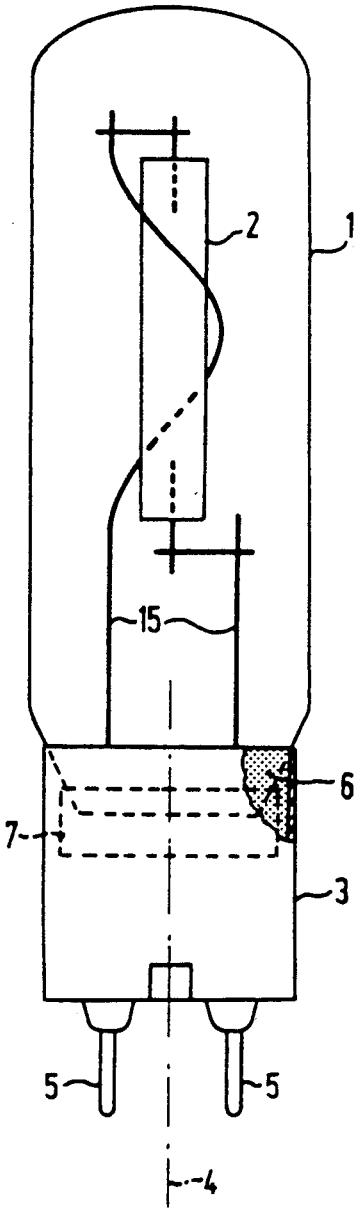
FIG. 1 is a side elevation of an electric lamp with a lamp cap broken away.

In FIG. 1, the electric lamp has a translucent lamp vessel 1, in which an electric light source 2, a high-pressure sodium vapour discharge lamp, is arranged. The lamp has a lamp cap 3 with an axis 4. The wall of the lamp cap 3 mainly consists of synthetic material, for example of polybutylene terephtalate. The lamp cap 3 has electrical contacts 5 on its outer side. Current supply conductors 15 extend from the light source 2 to the electrical contacts 5 at the lamp cap 3. The lamp vessel 1 is received partly into the lamp cap 3 and is fixed on the inner surface thereof by means of cement 6. A metal ring 7, which is in contact with the cement 6, is present in the lamp cap 3. It is not visible in FIG. 1 that spacer means separate the metal ring 7 from the wall of the lamp cap 3.

Figure 2:
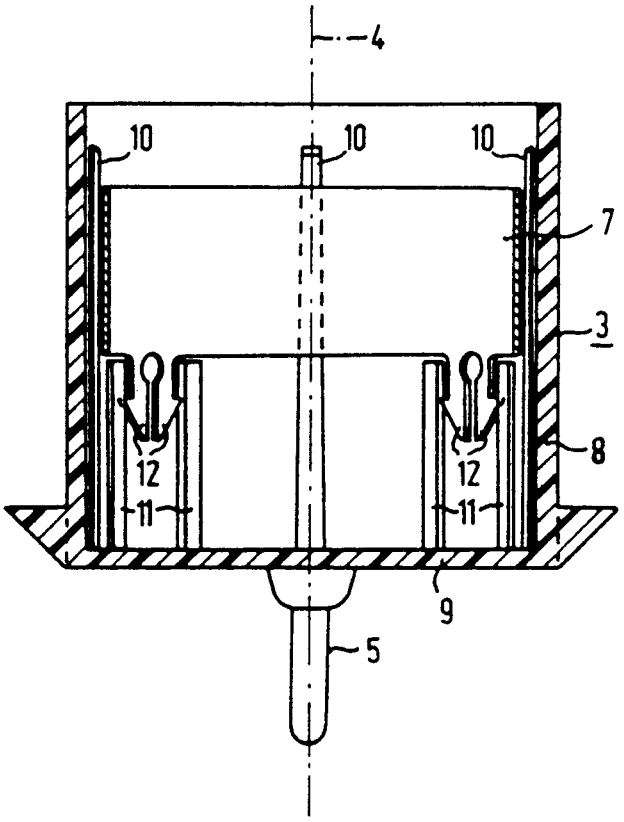
FIG. 2 is an axial sectional view of the lamp cap shown in FIG. 1.

In FIG. 2, the lamp cap 3 has an axis, a cylindrical wall 8 with an inside surface concentric to the axis, and a base portion 9. A metal ring 7 is present in the lamp cap 3. The ring 7 is formed from steel strip and is closed by welding or is closed by means of a flanged seam. The lamp cap 3 has circumferentially spaced first projections on the inside surface of the lamp cap, preferably in the form of first ribs 10. The ribs 10 are parallel to the axis and separate the metal ring 7 in radial directions from the wall 8 of the lamp cap 3. If the ring 7 is in contact with one or more ribs 10 when the ring is heated inductively, the ribs 10 act as heat resistances which prevent the wall 8 of the lamp cap 3 from being excessively heated. Especially if the lamp vessel 1 of FIG. 1 is provided with the lamp cap 3 in the position in which the lamp vessel 1 is situated within the lamp cap 3, the first ribs 10 constitute effective radial spacer means. The metal ring 7 then cannot contact the base portion 9 of the lamp cap 3 under the influence of gravity.

In the Figures, the spacer means also includes at least one second projection on the inner surface of the lamp cap 3, preferably in the form of pairs of parallel ribs 11 which separate the metal ring 7 in axial direction from the lamp cap 3. Each second rib 11 could be integrated with a first rib 10 and hence could be a raised portion thereof. The ribs 11 separate the metal ring 7 from the base wall portion 9 of the lamp cap 3. Mechanical fixing means including barbed arms 12 lock the metal ring 7 in the lamp cap 3 against displacement. Each pair of arms 12 has oppositely directed barbs and is received between a respective pair of ribs 11. The barbs engage respective ribs 11 t fix the ring 7 to the cap 3.

Due to the fact that the metal ring 7 is radially spaced from the lamp cap 3, the cement mass (for example a mixture of shellac, colophonium, silicone resin, phenol formaldehyde resin, hexamethylene tetra-amine, calcium carbonate and ethanol which starts seething when the temperature increases) can adhere around the metal ring 7 to the lamp cap 3 upon curing and can thus establish an intimate connection with the lamp vessel 1 (FIG. 1).

What is claimed is:

1. An electric lamp comprising a lamp cap of insulating synthetic material having an axis, a cylindrical wall with an inside surface concentric to said axis, and a base with electrical contacts therein, said inside surface having circumferentially spaced first projections thereon, a lamp vessel partly received in said lamp cap and fixed thereto by means of cement on the inside surface thereof, said vessel having therein an electric light source and conductors extending to said contacts, a metal ring fixed in the lamp cap in contact with said cement, said ring being radially separated from said inside surface by said circumferentially spaced first projections.

2. An electric lamp as in claim 1 wherein said first projections are ribs formed parallel to said axis.

3. An electric lamp as in claim 1 further comprising at least one second projection on said inside surface which separates the ring from the lamp cap in the axial direction.

4. An electric lamp as in claim 3 comprising a pair of said second projections circumferentially spaced, said ring having a pair of barbed arms received between a respective pair of second projections, said arms having oppositely directed barbs which engage respective second projections to fix said metal ring against displacement in the axial direction.

5. An electric lamp as in claim 4 wherein said second projections are ribs formed parallel to said axis.

* * * * *